US006729497B2

(12) United States Patent
Rice et al.

(10) Patent No.: US 6,729,497 B2
(45) Date of Patent: May 4, 2004

(54) PAINTBALL CONTAINER

(75) Inventors: John Ronald Rice, Staffordshire (GB); Mark Andrew Walker, Staffordshire (GB)

(73) Assignee: NPF Limited, Nechells (GB)

( * ) Notice: Subject to any disclaimer, the term of this patent is extended or adjusted under 35 U.S.C. 154(b) by 0 days.

(21) Appl. No.: 10/248,144

(22) Filed: Dec. 20, 2002

(65) Prior Publication Data

US 2003/0121927 A1 Jul. 3, 2003

(30) Foreign Application Priority Data

Dec. 28, 2001 (GB) ..... 0130999
Nov. 19, 2002 (GB) ..... 0226936

(51) Int. Cl.[7] ..... B65D 43/16

(52) U.S. Cl. ..... 220/835; 220/837; 220/839; 220/833

(58) Field of Search ..... 220/827, 830, 220/831, 832, 833, 834, 835, 837, 838, 839, 840; 215/235, 224, 225, 237; 224/625, 931

(56) References Cited

U.S. PATENT DOCUMENTS

| | | | | | |
|---|---|---|---|---|---|
| 1,503,187 | A | * | 7/1924 | Fitchett | 220/830 |
| 1,629,747 | A | * | 5/1927 | Stathes et al. | 220/830 |
| 2,594,467 | A | * | 4/1952 | Lynch, Jr. et al. | 220/830 |
| 2,852,054 | A | * | 9/1958 | Motley | 220/834 |
| 3,584,760 | A | * | 6/1971 | Grinker | 220/375 |
| 3,826,394 | A | * | 7/1974 | Stull | 215/224 |
| 3,863,797 | A | * | 2/1975 | Berghahn | 215/225 |
| 3,901,401 | A | * | 8/1975 | Lynn et al. | 215/224 |
| 4,087,016 | A | * | 5/1978 | Towns et al. | 215/224 |
| 4,170,315 | A | * | 10/1979 | Dubach et al. | 220/835 |
| 4,429,800 | A | * | 2/1984 | Greenspan | 215/224 |
| 4,513,888 | A | * | 4/1985 | Curry | 222/517 |
| 4,538,731 | A | * | 9/1985 | Cillario | 220/835 |
| 5,031,784 | A | * | 7/1991 | Wright | 215/237 |
| 5,083,671 | A | * | 1/1992 | Hayes | 215/235 |
| 5,137,260 | A | * | 8/1992 | Pehr | 215/237 |
| 5,190,196 | A | * | 3/1993 | Hamer, III | 224/625 |
| 5,702,013 | A | * | 12/1997 | Freed | 215/238 |
| 6,015,058 | A | | 1/2000 | Parks | |
| 2001/0050264 | A1 | * | 12/2001 | Schorner | 215/237 |
| 2002/0014493 | A1 | * | 2/2002 | Delmon | 220/835 |
| 2002/0059927 | A1 | * | 5/2002 | Woods | 124/45 |

FOREIGN PATENT DOCUMENTS

| | | | | |
|---|---|---|---|---|
| EP | 0215756 A2 | | 3/1987 | |
| GB | 550677 | * | 1/1943 | ..... 220/FOR 193 |
| GB | 2252302 | * | 5/1992 | |
| GB | 2252302 A | | 8/1992 | |
| JP | 11-321909 | * | 11/1999 | |
| JP | 2000-168815 | * | 6/2000 | |

* cited by examiner

*Primary Examiner*—Nathan J. Newhouse
(74) *Attorney, Agent, or Firm*—Vedder Price Kaufman and Kammholz, P.C.; Robert S. Beiser, Esq.

(57) ABSTRACT

A paintball container comprises a body 12 and a lid 14. The lid 14 is hinged to the body 12 at one side, and has a tab 42 at the other side to facilitate opening of the container. The body 12 has a guard 26 formed on it adjacent to the tab 42 on the lid. The guard is substantially U-shaped and bounds a recess 30 into which a user can insert their thumb to pull up the tab 42 to release the lid. The guard 26 prevents accidental opening of the lid, for example when the container is being removed from a harness in which it is being carried.

55 Claims, 12 Drawing Sheets

PAINTBALL CONTAINER

BACKGROUND OF INVENTION

This invention relates to paintball containers.

Current containers for paintballs typically store up to 150 paintballs and have a lid that snap fits upon a rim at an open end of the container body. The body can be a one-piece moulding or can be formed as a cylindrical tube with a collar around the top which forms the top end of the body and engages with the lid. The lid has a tab projecting from its edge to aid a player in opening the container, typically by engaging the tab with their thumb and pushing the lid away from the body.

Modern paintball harnesses are arranged to hold a number of such paintball containers around a player's waist. The containers are typically held in the harness by elastic hoops with the containers' lids pointing towards the ground. This allows the player to grab a container of paintballs, pull it downwards out of the harness, and open it quickly, usually in a single movement, and usually using only one hand because the other hand is still being used to hold the paintball gun or marker. The harness sometimes includes an overstrap that covers the lid and supports the container, when the container is held in the harness, the overstrap being fastened, for example, with Velcro. In some harnesses the containers are retained horizontally with their upper ends pointing outwards to the player's side.

Upon removal of the container from the harness the player's hand tends to drive the container further into the harness prior to removing it therefrom, even when the harness does not hold the containers with their lids facing the ground. The tab on the lid can catch on the harness and separating the lid from the body such that the container is, at least partially, open. This premature opening of the container often results in the paintballs stored in the container being dropped onto the ground, which is clearly undesirable.

A further problem associated with current paintball containers is that, because the player is only using one hand, in order to open them it is necessary to support the container, typically against the player's body. The force necessary to open the container then tends to push the container out of the player's grip due to the bulky nature of the container, typically 60 mm diameter. This problem is exacerbated by the use of protective gloves by players.

It is an aim of the present invention to provide a paintball container that, at least partially, ameliorates at least one of the aforementioned problems.

SUMMARY OF INVENTION

According to a first aspect of the present invention there is provided a paintball container comprising a body, a lid, and a hinge connecting the lid to the body. When the container is in a closed condition the lid is arranged to engage with the body to close the container. The container includes release means positioned substantially opposite the hinge to enable opening of the container, and the body has a guard protruding therefrom, the guard being substantially opposite the hinge so that, with the lid in the closed condition, the guard is adjacent at least part of the release means, thereby being arranged to direct a foreign body travelling longitudinally over the body towards the lid past the release means to prevent unintentional opening of the container.

Where the container is of a circular cross section, the release means and the guard may be exactly diametrically opposite the hinge, or offset from that position, preferably being in any position up to 30° to either side of diametrically opposite. However, for the user to be able to open the container, the guard and release member only need to be on the opposite side of the container to the hinge. In some cases the container can include two release means and two guards both positioned on the opposite side of the container to the hinge.

This arrangement has an advantage over prior art arrangements, in that the guard guides or deflects potential snags away from the release means without them engaging the release means and thereby opening the container and allowing any paintballs stored therein to be expelled over the ground.

Preferably the container has defined therein a recess arranged to accommodate a user's digit, wherein the guard, at least partially, bounds the recess. Preferably the release member is located in the recess. This allows easy release of the lid by the user.

The release means may be formed on the body.

Preferably the container comprises a catch for holding the lid in the closed condition, and the release means is arranged to release the catch. This arrangement has the additional benefit that it is removes the necessity to push a tab upward thereby eliminating the tendency of the container to move away from the user as they open the container, typically with gloved hands.

Preferably the release means is formed integrally with the body. For example, the release means may be formed as part of the body by means of at least one slot through the body, the slot being arranged to allow movement of said a part. Said part may have a lip at a free end thereof, and the lid may have a slot therein, the lip being arranged to releasably engage in the slot when the lid is in the closed condition.

Preferably said part is resiliently deformable and is arranged to disengage the lip from the slot upon being deformed.

Alternatively the release means may comprise a part of the lid arranged to be engaged by the user's digit so as to urge the lid away from the body, to open the container. For example the release means may comprise a tab formed on the lid.

Preferably the guard extends, and tapers inwardly, away from the lid when the lid is in the closed condition. This can help to deflect objects away from the release means.

The present invention further provides a paintball container comprising a body, a lid movable relative to the body to open the container, a hinge connecting the lid to the body, and a release means positioned substantially opposite the hinge and operable to release the lid from the body to allow opening of the container, wherein the container further comprises a guard, the guard being positioned substantially opposite the hinge and arranged so as to deflect a foreign body, travelling over the body towards the lid, past the release means to prevent unintentional opening of the container.

The present invention still further provides a paintball container comprising a body, a lid movable relative to the body between a closed position and an open position, a hinge connecting the lid to the body, and release means positioned substantially opposite the hinge and operable to release the lid from the body to allow movement of the lid to the open position, wherein the container includes a guard, the guard being located adjacent the release means and projecting from the container at least as far as the release means so as to guard the release means from unintentional operation.

The present invention yet further provides a paintball container comprising a body, a lid releasably securable in a closed position on the body, and a release means operable to release the lid from the body to allow opening of the container, wherein the container includes a guard, the guard being aligned with the release means and projecting from the container at least as far as the release means so as to guard the release means from unintentional operation.

The body may be a one-piece body, or it may be a two-piece body which comprises a tubular portion and a collar. In the case of a two-piece body, the guard may be formed by the collar.

There may be only one release means and one guard, or there may be two or more release means.

The present invention yet further provides a method of storing a paintball including placing the paintball in a container according to the invention.

The invention will now be described, by way of example only, with reference to the accompanying drawings.

DETAILED DESCRIPTION

Figure 1A:
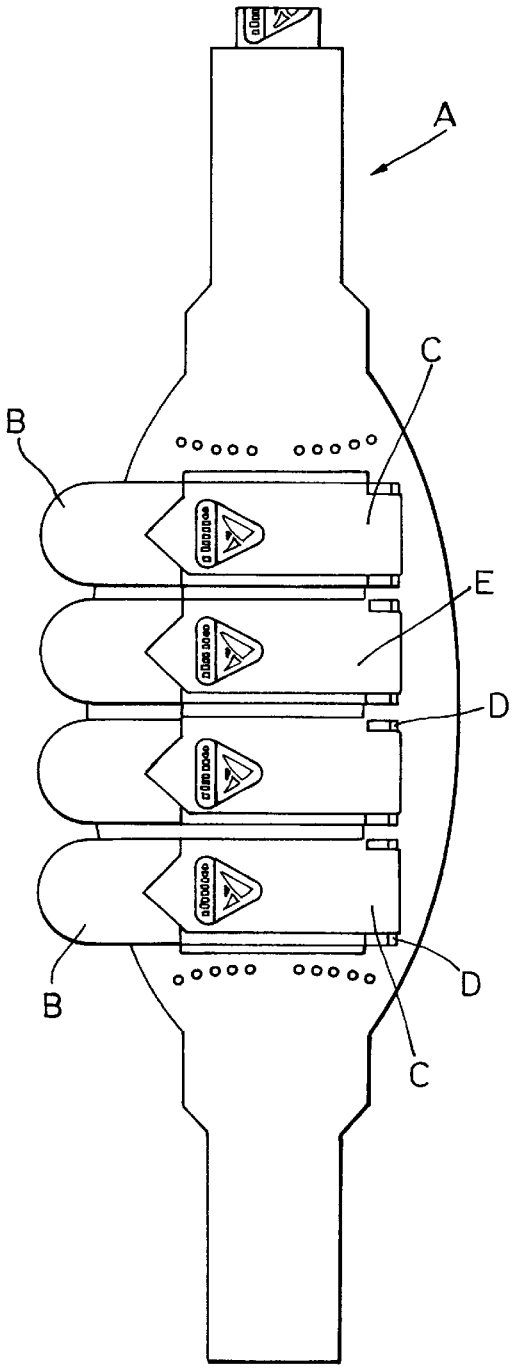
Fig. 1a (PRIOR ART)
FIG. 1*a* is a rear elevational view of one example of a conventional paintball container harness.
Figure 1B:
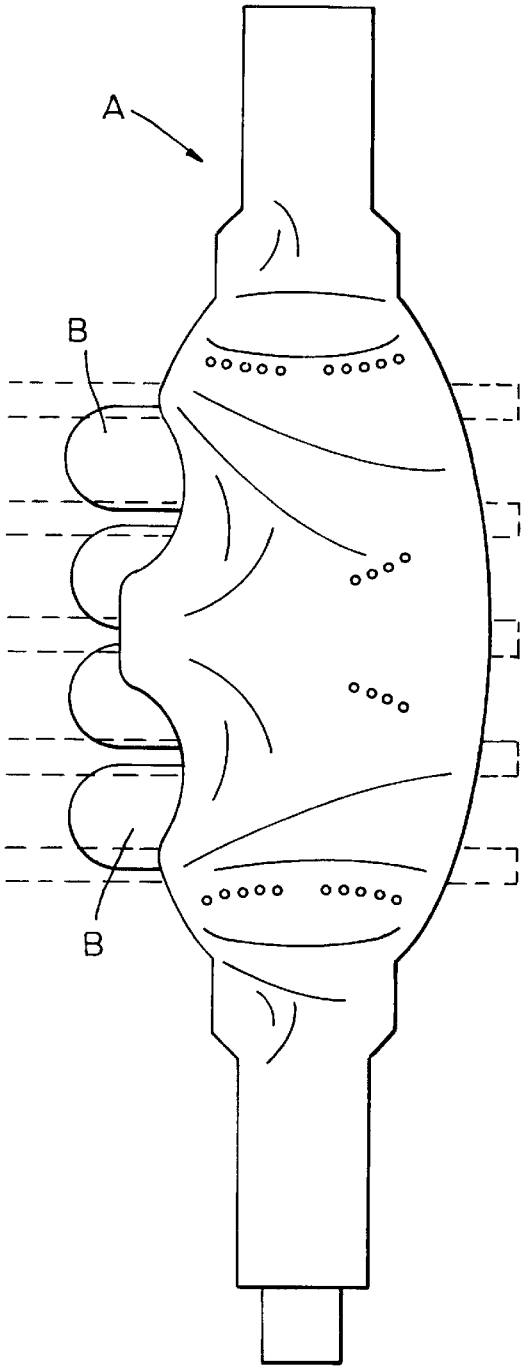
Fig. 1b (PRIOR ART)
FIG. 1*b* is a front elevational view of the harness of FIG. 1*a;*
Figure 2A:
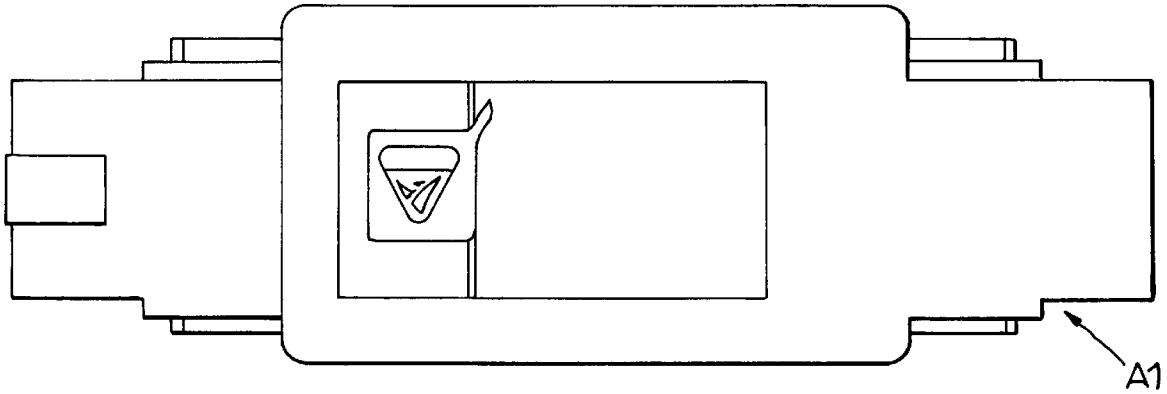
Fig. 2a (PRIOR ART)
FIGS. 2*a* is a front elevational view of a second example of a conventional paintball harness.
Figure 2B:
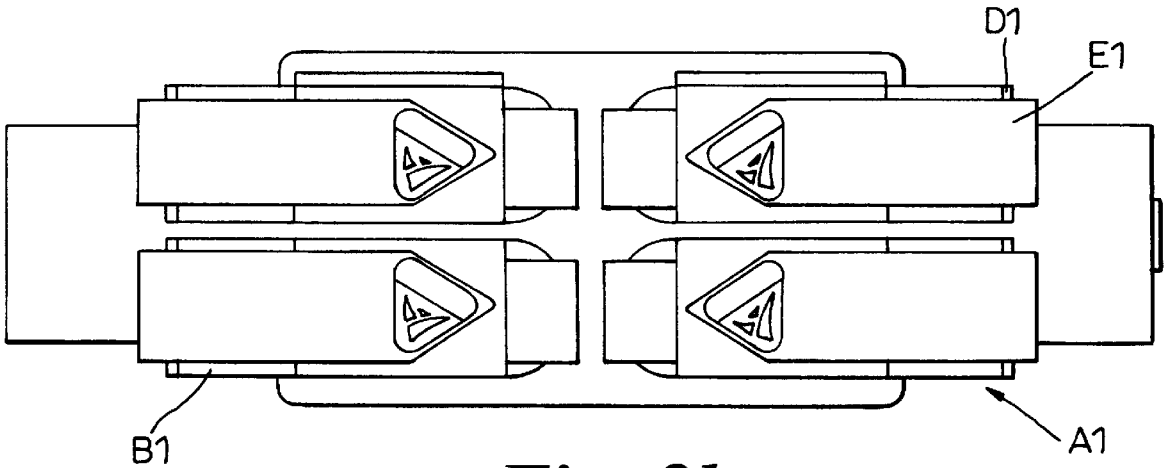
Fig. 2b (PRIOR ART)
FIG. 2*b* is a rear elevational view of the harness of FIG. 2*a*.
Figure 2C:
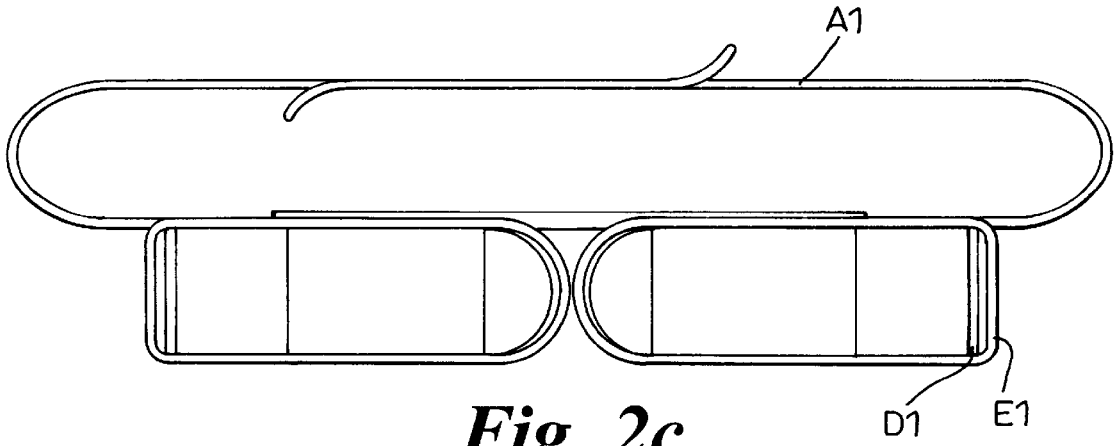
Fig. 2c (PRIOR ART)
FIG. 2*c* is a top view of the harness of FIG. 2*a*.
Figure 2D:
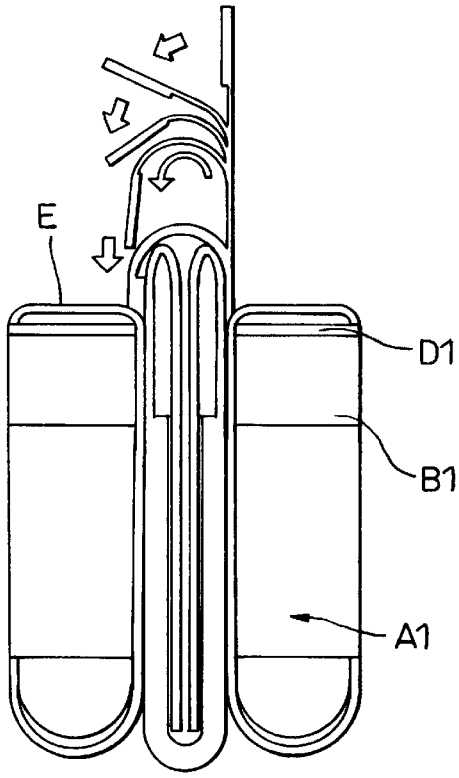
Fig. 2d (PRIOR ART)
FIG. 2*d* is a top view of the harness of FIG. 2*a* in a folded condition.

Referring to FIGS. 1*a* and 1*b*, a first known design of paintball harness A is arranged to hold a number of paintball containers B around a player's waist. The containers B are held in the harness by elastic hoops C with containers' lids D pointing towards the ground. This allows the player to grab a container B of paintballs and open it quickly, usually in a single movement. The harness includes a releasable overstrap E for each container B that covers lid D, when the container B is held in the harness A.

Referring to FIGS. 2*a*, 2*b*, 2*c* and 2*d*, in a second known design of paintball harness A1 the containers B1 are held horizontally against the lower part of a player's back, with the harness secured around the player's waist. The containers B1 are held with their lids D1 pointing outwards to the side of the player, with the overstraps E1 releasably secured over their lids D1.

Figure 3:
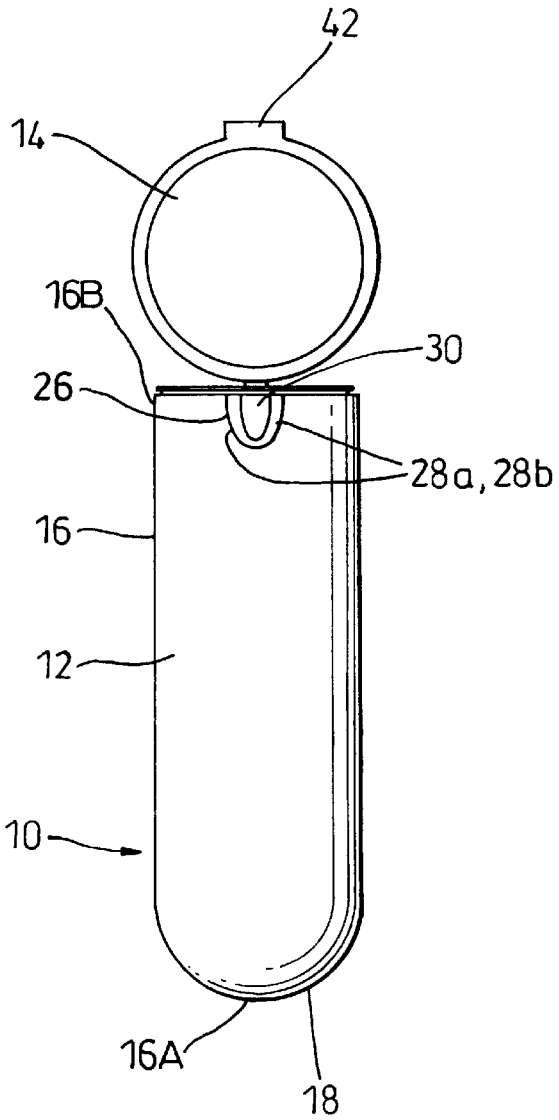
FIG. 3 is a front elevational view of a paintball container according to a first embodiment of the present invention.
Figure 4:
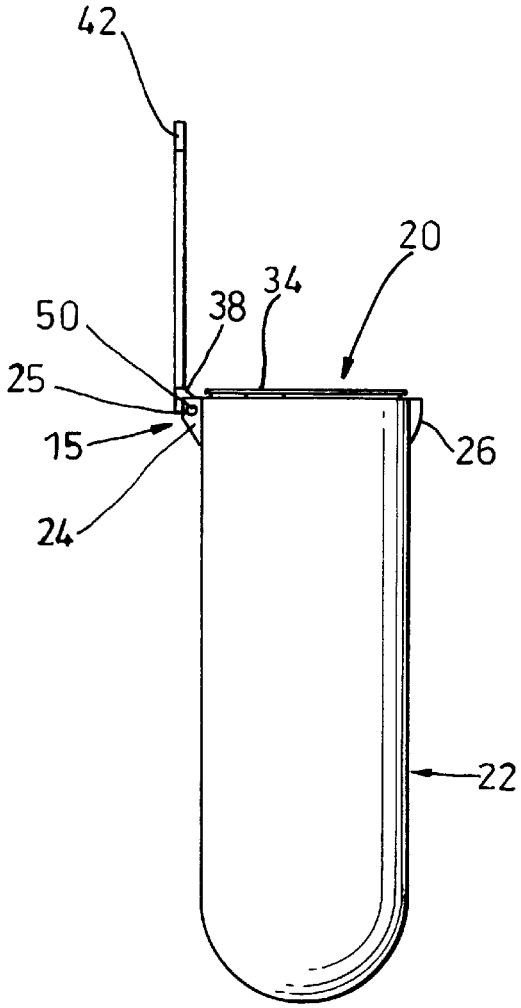
FIG. 4 is a side elevational view of the paintball container of FIG. 3.
Figure 5:
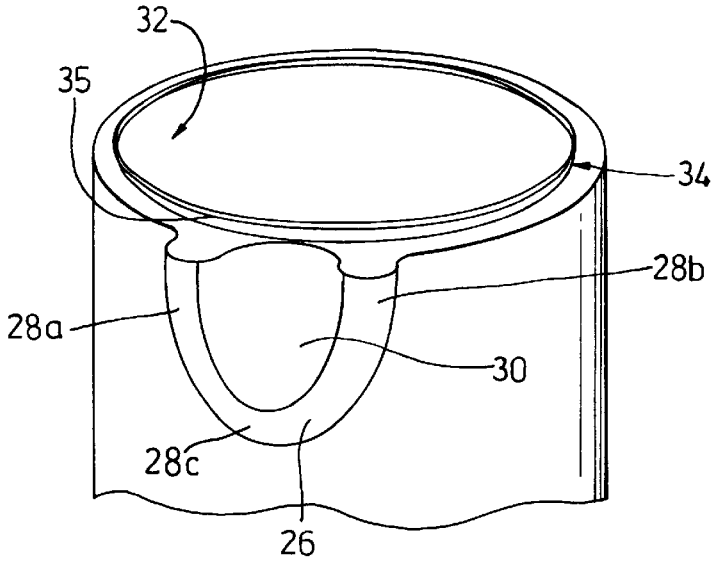
FIG. 5 is a partial perspective view of a free end of a body of the paintball container of FIG. 3.

Referring now to FIGS. 3 to 5, a paintball container according to a first embodiment of the invention 10 comprises a body 12 and a lid 14 attached to the body by means of a hinge 15. The body 12 comprises a plain hollow, circular cylinder 16 that terminates at one end, its closed bottom end 16A, in an outwardly convex, hollow hemispherical dome 18 and is open at another end 16B, which forms its top end 20. The body 12 typically has a length to diameter ratio of approximately 4:1 and can typically accommodate between 100 and 140 paintballs. The body 12 is of constant cross section, in this case of constant diameter, over the main part of its length, so that it can be easily slid into and out of a harness.

An outer surface 22 of the top end 20 of the cylinder 16 has a pair of spaced apart hinge knuckles 24 (only one shown) projecting therefrom adjacent the open end 20, which form part of the hinge 15 on one side of the container. Each of the knuckles 24 has a circular aperture 25 (only one shown) therethrough along a common axis substantially tangential to the outer surface 22. The outer surface 22 has a substantially U-shaped smooth, curved protrusion projecting radially therefrom and forming a guard 26 thereupon. The guard 26 is positioned on the opposite side of the container to the hinge, in this case diametrically opposite the hinge 15. The outer side of the guard 26 extends at a shallow angle relative to the surface 22. Two side portions or arms 28*a*, 28*b*, which form the sides of the U-shaped guard 26, extend longitudinally along the body, away from the open end 20 and the lid 14, and then converge to form a tapered lower portion 28*c*. The guard 26 therefore tapers inwardly as it extends away from the top end 20 of the container.

A curved, inwardly concave recess 30 is formed between the arms 28*a, b* and the lower portion 28*c* of the guard 26. The recess 30 is sized to accommodate the tip of a user's thumb. The guard 26 therefore bounds the lower end of the recess 30 which is furthest from the lid 14. The guard 26 also extends around the sides of the recess 30 adjacent to the lid 14.

Figure 6:
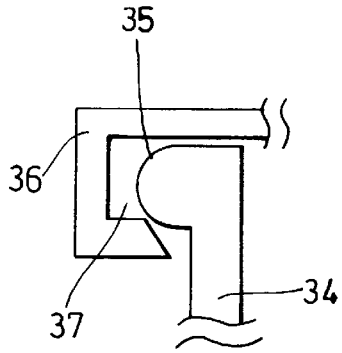
FIG. 6 is a partial cross-section through a snap fit arrangement between a body and a lid of the paintball container of FIG. 3.

Referring to FIGS. 5 and 6, the open top end 20 of the cylinder 16 has an annular rim 34 projecting longitudinally therefrom. The rim 34 lies flush with an inner surface 32 of the body 12 and is narrower than the body 12. The rim 34 has an outwardly projecting radial lip 35 thereabout, at its top edge, remote from the cylinder 16.

The lid 14 is substantially circular and has a peripheral lip 36 projecting therefrom, as can best be seen in FIG. 6. The lip 36 has a groove 37 therein and has an inner diameter that is preferably very similar to the external diameter of the rim 34 on the body 12. As can best be seen in FIGS. 3 and 4, a tab 42 projects radially from the lid 14, at a position which is diametrically opposite the hinge 15. The tab 42 projects from the lid 14 by substantially the same amount as the arms 28*a*, 28*b* of the guard 26 project from the body 12. The tab 42 also extends around substantially the same amount of arc as the arms 28*a*, 28*b*, and across the upper end of the recess 30. Therefore, when viewed longitudinally of the container, the guard 26 and the tab 42 are aligned in the circumferential direction, and the guard 26 projects radially from the body at least as far as the tab 42, over the whole of the extent of the tab in the circumferential direction. When viewed in the longitudinal direction the guard 26 covers the whole of the area of the tab 42.

Figure 7:
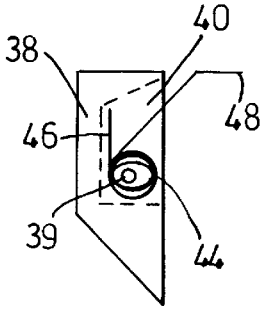
FIG. 7 is a sectional view of a hinge knuckle, incorporating a spring loading mechanism, of the lid of the paintball container of FIG. 3.

A lid knuckle 38 projects from an edge of the lid 14 diametrically opposite the tab 42. As shown in FIG. 7, the lid knuckle 38 has a circular aperture 39 therethrough that opens into an open chamber 40 approximately half way through the lid knuckle 38, and the lid knuckle 38 is sized to fit snugly between the body knuckles 24. A coil spring 44 is located in the chamber 40, coaxially with the aperture 39. A first free end 46 of the spring 44 rests on an inner wall of the chamber 40 and a second free end 48 lies externally of the lid knuckle 38.

Referring to FIGS. 4 and 7, the lid knuckle 38 lies between the body knuckles 24 and a pin 50 passes through the respective apertures 25, 39, the chamber 40 and the spring 44. The second free end 38 of the spring 44 abuts the knuckle 24 adjacent the open end 20 of the body 12. Thus the lid 14 is hingedly attached to the body 12. The action of the spring results in the lid 14 being urged away from the body 12 when the container 10 is in an open configuration.

Referring to all of FIGS. 3 to 7, with the container 10 in a closed configuration the lip 35 on the top of the body engages in the groove 37 in the lid, typically as a snap fit. In the closed configuration the guard 26 and tab 42 are adjacent each other and present a substantially continuous smooth surface surrounding the recess 30. The recess 30 is therefore partly bounded, on one side, by the tab 42 and partly bounded, around the rest of its perimeter, and in particular on the side opposite the tab 42, by the guard 26. The guard 26 extends or projects radially outwardly from the body 12 at least as far as, and preferably further than, the tab 42. The guard 26 is also at least as wide as, and preferably wider than, the tab 42 in the circumferential direction around the container. The guard 26 is positioned between the tab 42 and the closed end 18 of the container and extends over the whole of the circumferential extension of the tab 42. Indeed over the whole of the circumferential extension of the tab, the guard 26 projects at least as far in the radial direction as does the tab 42. The guard 26 serves to guard the tab 42 in order to prevent accidental or unintentional opening of the container. In particular, any body or surface travelling longitudinally over the body towards the lid, which might otherwise snag on the tab 42, is guided over the tab 42 by the guard 26. For example, when the container 10 is held in a harness, such as those of FIGS. 1*a* and 1*b* or FIGS. 2*a*, 2*b*, 2*c* and 2*d*, then if a user is trying to pull the container 10 from the harness with a gloved hand, he is far less likely to accidentally open the container 10 by pulling open the lid 14.

With the container 10 in a closed configuration, a user opens the container 10 by placing their digit, typically their thumb, in the recess 30, engaging the tab 42 therewith. The user then pushes against the tab 42 to overcome the frictional force between the lip 36 and the rim 34 and urge the lid 14 away from the body 12 in a conventional manner to release the lid 14 from the body 12. When the lid is released, it will be urged away from the body 12 towards the open position shown in FIGS. 3 and 4. It will be appreciated that the guard also serves as a guide to help the player to feel the correct position in which to place his thumb to open the container. The top and bottom of the recess formed by the tab 42 and the curved portion 28*c* of the guard locate the users thumb in the longitudinal direction, and the arms 28*a*, 28*b* of the guard locate the users thumb in the circumferential direction. The arms 28*a*, 28*b* of the guard also form a channel which will guide the players thumb along it as he moves it in an upward direction to open the lid 14 of the container.

It will be appreciated that, if the container 10 is used on a harness such as those shown in FIGS. 1*a* and 1*b* or FIGS. 2*a* to 2*d*, a user can extract the container from the harness with much less risk of accidental opening of the container than with a conventional container, since the tab 42 is protected by the guard 26.

Figure 8:
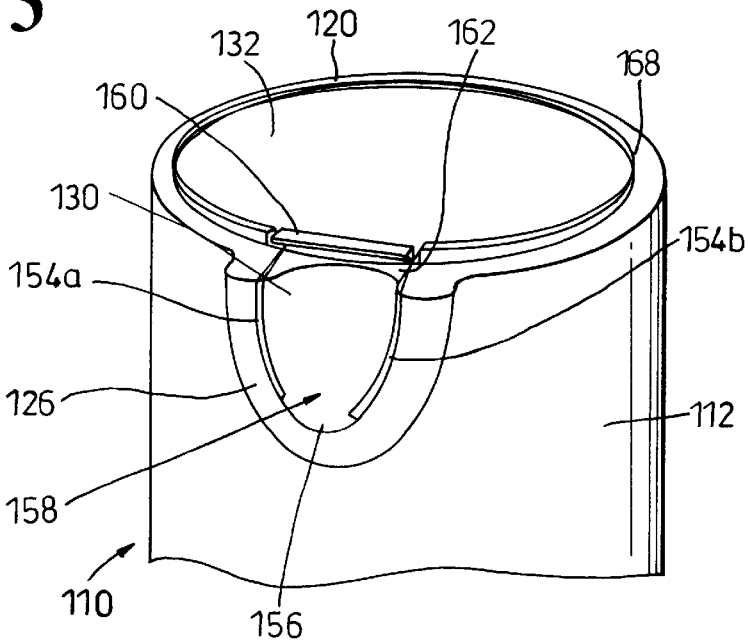
FIG. 8 is a partial perspective view of a body of a paintball container according to a second embodiment of the present invention.
Figure 9:
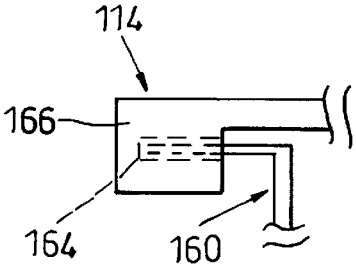
FIG. 9 is a partial cross-section through a catch arrangement between a body and a lid of the container of FIG. 8.

Referring to FIGS. 8 and 9, a paintball container 110 according to a second embodiment of the present invention is disclosed which is substantially similar to the first embodiment and similar parts are accorded similar reference numerals in the one hundred series. The body 112 has slots 154*a,b* therethrough at the conjunction of the guard 126 and the recess 130. The slots 154*a,b* extend from the open end 120 but do not extend all the way around the recess 130, such that a hinge portion 156 of the body 112 remains within the recess 130 remote from the open end 120. Thus, due to the resilient nature of the material from which the container 110 is fabricated, typically high density polyethylene (HDPE) or polypropylene, the portion 130 of the body 12 between the slots 154*a,b* defines an integrally formed inwardly depressible, resilient catch 158.

The catch 158 has a substantially L-shaped lip 160 projecting from its upper free end 162 adjacent the inner surface 132 of the body 112.

The lid 114 has a slot 164 in an inner surface of a peripheral lip 166 that is arranged to engage the lip 160 when the container 110 is in a closed configuration. The engagement of the lip 160 of the catch 158 in the slot 164 holds the lid 114 shut. In this embodiment the lip 166 and rim 168 are plain and do not snap fit together. However in an alternative embodiment the lid 114 may snap fit onto the body 112.

A user opens the container 110 by placing their digit, typically their thumb, in the recess and urging the catch 158 inwards to disengage the lip 160 from the slot 164, thereby releasing the catch. The lid 114 is then urged away from the body 112 in the conventional manner by means of the spring in the hinge, which is not shown in FIGS. 8 and 9 but corresponds to that in FIG. 7. In this embodiment the guard 126 serves to guard not only the tab 142 but also the catch 158 from accidental actuation, thereby preventing the premature opening of the container 110 with the attendant risk of dropping the paintballs.

It will be appreciated that the lid 114 of the second embodiment may or may not have a tab corresponding to the tab 42 of the first embodiment. In the case where the lid 114 does not have a tab, the lid 114 will typically be urged away from the body 112 by the action of a spring as described hereinbefore in relation to the first embodiment of the invention, or by the user lifting the lid 114 away. Where the lid 114 does have a tab, the lid 114 is typically urged away from the body 112 by the spring action or by the user engaging the tab with their digit.

In each of the first and second embodiments the body 12, 112 and the lid 14, 114 are typically fabricated by injection, or blow, moulding from HDPE or polypropylene. The body 12, 112 and lid 14, 114 are placed in a closed configuration and allowed to cool together. This results in better matching of the lip and rim, thus achieving an effective snap fit arrangement without excessive frictional engagement therebetween. Excessive frictional engagement between the lip and the rim results in difficulties for a user when opening the container.

Figure 10:
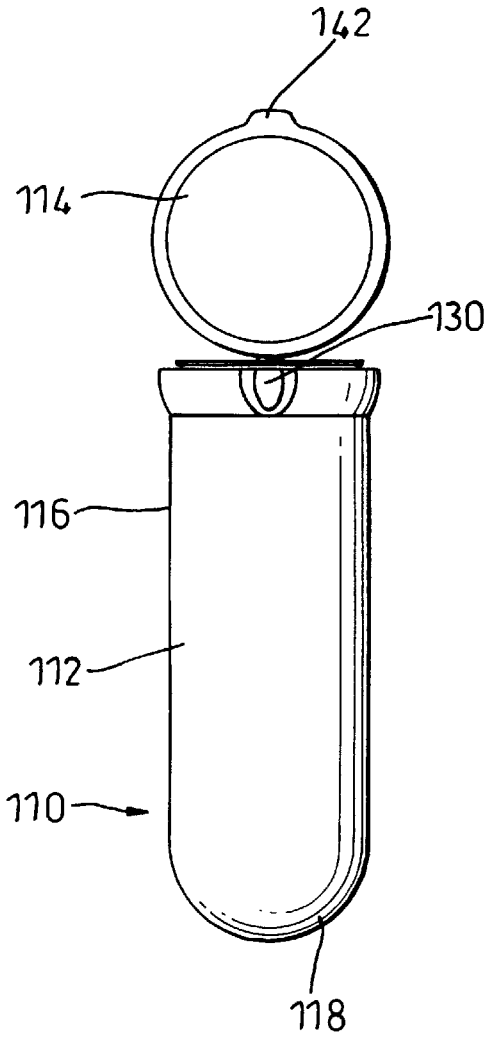
FIG. 10 is a front elevational view of a paintball container according to a third embodiment of the present invention.
Figure 11:
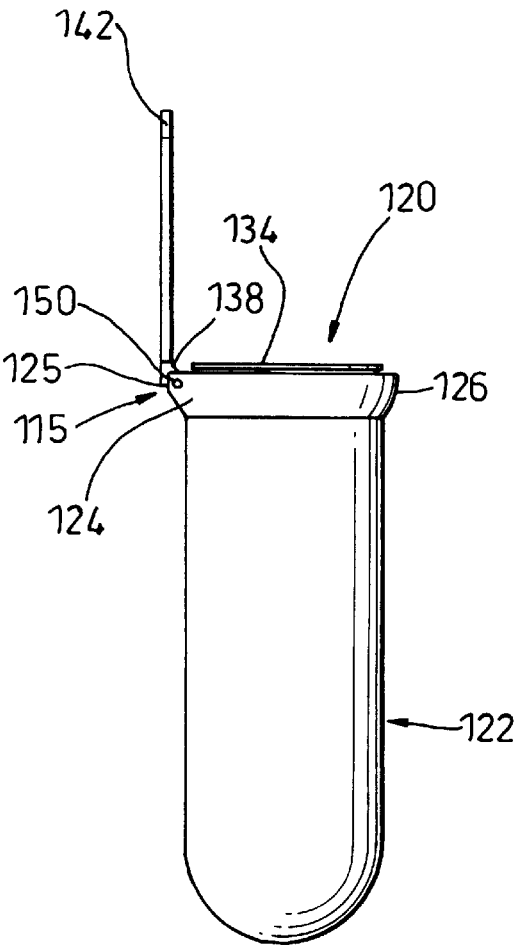
FIG. 11 is a side elevational view of the paintball container of FIG. 10.

The container body may also be formed in two or more parts. FIGS. 10 and 11 show a third embodiment of the invention which is similar to the first embodiment, corresponding components being indicated by the same reference numerals but increased by 100. The body 112 comprises a tubular portion 112*a* and a collar 112*b* which fits round the top of the tubular portion 112*a* and includes the body knuckles 124 of the hinge 115. The collar 112*b* protrudes from the side of the tubular portion 112*a*, and has a recess 130 in it. The portion 126 of the collar around the recess 130 therefore forms the guard 126. As the lid 114 has the same diameter as the collar, the recess 130 exposes a part 142 of the underside of the main circular part of the lid 114 which can be engaged by the users finger or thumb to open the container, and a tab on the lid is therefore not required.

Figure 12:
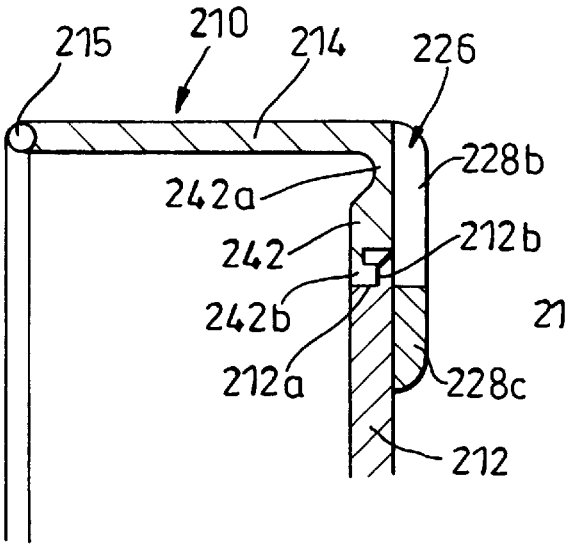
FIG. 12 is a partial cross-section through a paintball container according to a fourth embodiment of the invention.
Figure 13:
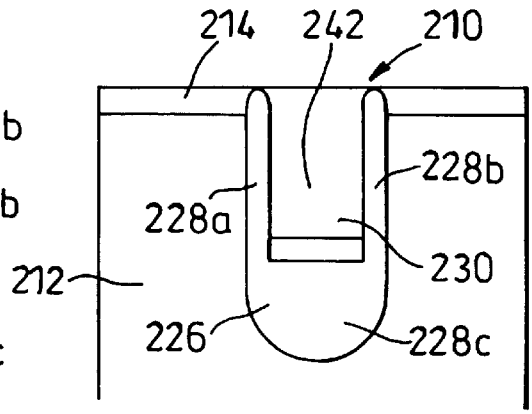
FIG. 13 is a partial front elevational view of the container of FIG. 12.

Referring to FIGS. 12 and 13, in a fourth embodiment of the invention the lid 214 is hinged to the body 212 by means of a hinge 215. The front of the lid 214 has a tab 242 projecting vertically downwards from it which has a narrow flexible portion 242*a* at its base. The body 212 has a cut-out 212*a* formed in it into which the tab 242 fits when the lid is closed. The tab 242 also has a horizontally extending projection 242*b* at its lower end which fits into a recess 212*b* in the body 212, along the bottom of the cut-out 212*a*, to retain the lid in the closed position as shown in FIG. 12. Also projecting downwards from the front of the lid 214, and surrounding the tab 242, is a raised guard portion 226, having two sides 228*a*, 228*b* and an end portion 228*c*. When the lid is in the closed position the guard portion 214*a* rests against the outside of the body 212, with its sides 214*b*, 214*c* adjacent the sides and of the cutout 212*a* and its end portion 214*d* adjacent the bottom of the cut-out 212*a*. The guard 226 therefore defines the sides and bottom edge of a recess 230 in which the tab 242 is located.

In operation the user places his thumb or finger in the recess 230 and presses on the tab 242, which releases the catch formed by the tab 242, the projection 242*b* and the recess 212*b*, thereby allowing the lid 214 to be opened. As the lid 214 is opened, the guard 226 slides up the side of the body 212. When the lid 214 is closed with the release catch 242, 242*b*, 212*b* engaged, the guard 226 guards the tab 242 against unintentional depression, and hence reduces the likelihood of unintentional opening of the container 210.

Figure 14:
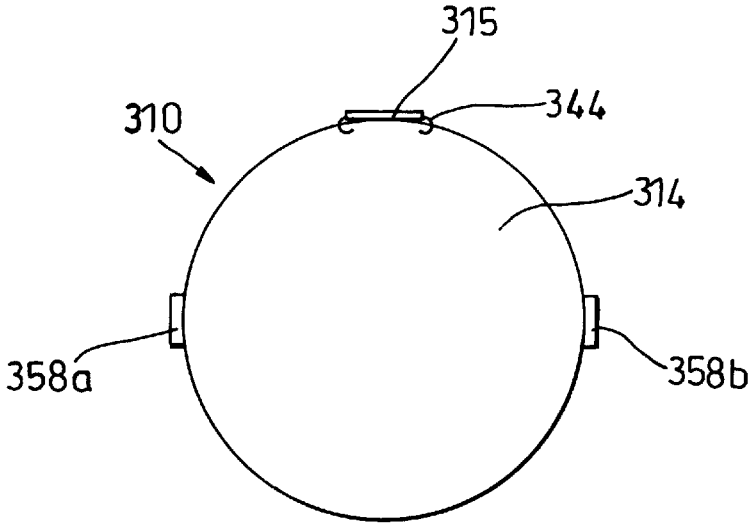
FIG. 14 is a top plan view of a paintball container according to a fifth embodiment of the invention.

Referring to FIG. 14, in a fifth embodiment of the invention, there are two release catches 358*a*, 358*b*, each of which is the same as the release catch 158 described above with reference to FIGS. 6 to 9. The lid 314 is connected the body of the container 310, which is not visible in FIG. 14, by means of a hinge 315 which is spring loaded by means of a spring 344, and which urges the lid 314 towards an open position. The two release catches 358*a*, 358*b* are on opposite sides of the container from each other, and equally spaced from the hinge 315 in the circumferential direction around the lid, both being spaced from the hinge 315 by about 90°. Therefore, to release the lid 314 in this embodiment the user can use his thumb and forefinger simultaneously on the two catches 358*a*, 358*b* to release them and allow the lid 314 to open under the force of the spring 344.

It will be appreciated that, although described as having a spring loaded hinge arrangement the hinge arrangement need not be spring loaded. Indeed the container need not have a hinge arrangement, it may have a push off lid. It will also be appreciated that although described as being of circular cross-section the container may be of any convenient cross-section.

Figure 15:
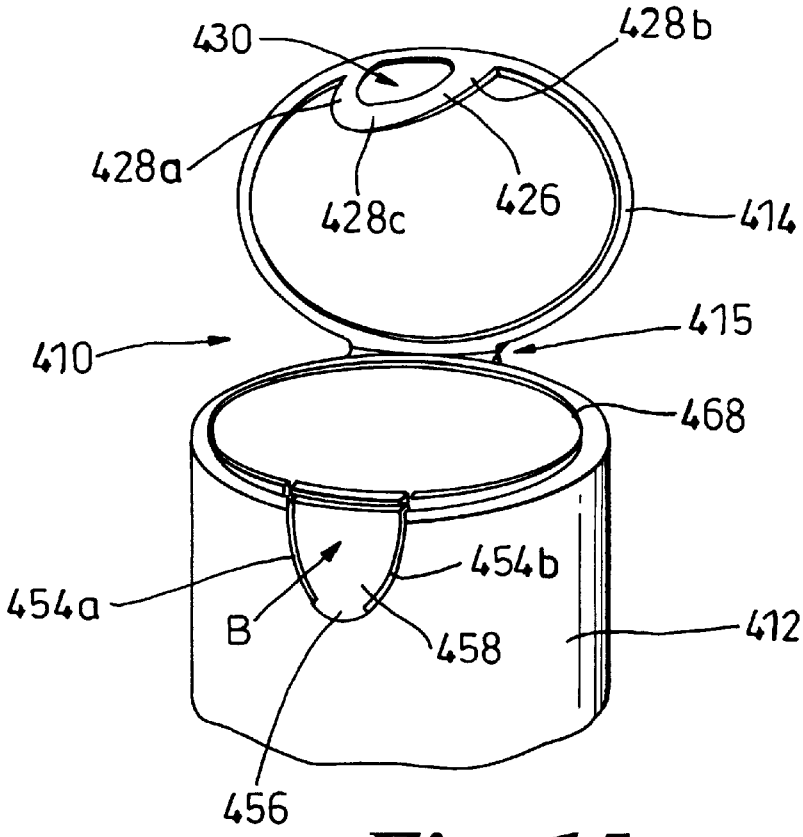
FIG. 15 is a partial perspective view of a paintball container according to a sixth embodiment of the invention.
Figure 16:
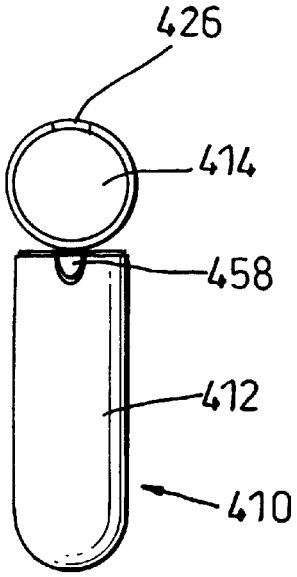
FIG. 16 is a front elevational view of the container of FIG. 15.
Figure 17:
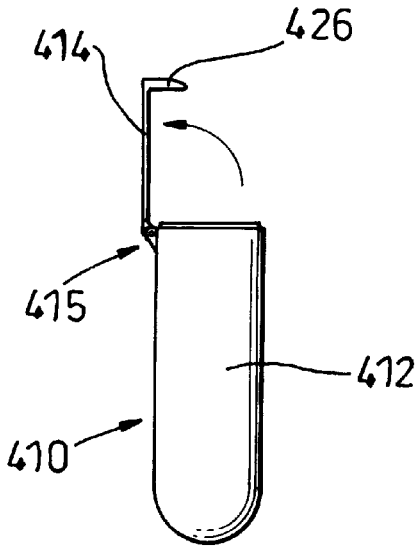
FIG. 17 is a side elevational view of the container of FIG. 15.

Referring to FIGS. 15 to 17 a paintball container 410 according to a sixth embodiment of the present invention is disclosed which is similar to the second embodiment except that the guard 426 is formed on the lid 414. The body 412 has two slots 454*a*, 454*b* formed in it which define a catch 458 therebetween which is connected to the rest of the body 412 by a flexible hinge portion 456. This catch operates to secure and release the lid in similar manner to that of FIGS. 8 and 9. The lid 414 has the guard 426 formed on it, the guard 426 being formed as a U-shaped projection having its two sides 428*a*, 428*b* connected to the lid 414 and a lower portion 428*c* joining the two sides 428*a*, 428*b* together. The guard 426 and the lid 414 therefore define an aperture 430 therethrough. When the lid 414 is closed, the guard is aligned with catch 458, with its sides 428*a*, 428*b* overlying the slots 454*a*, 454*b*.

To open the container 410 the user places his thumb through the aperture 430 in the guard and depresses the catch 458 in the direction of the arrow B in FIG. 15 to release the lid 414. He then pulls the lid 414 open with his thumb. It will be appreciated that, if the hinge 415 connecting the lid 414 to the body 412 is spring loaded, the user will need to remove his thumb from the aperture 430 once the catch 458 has been released to allow the lid to move away from the body into the open position shown in FIGS. 17 and 18.

Figure 18:
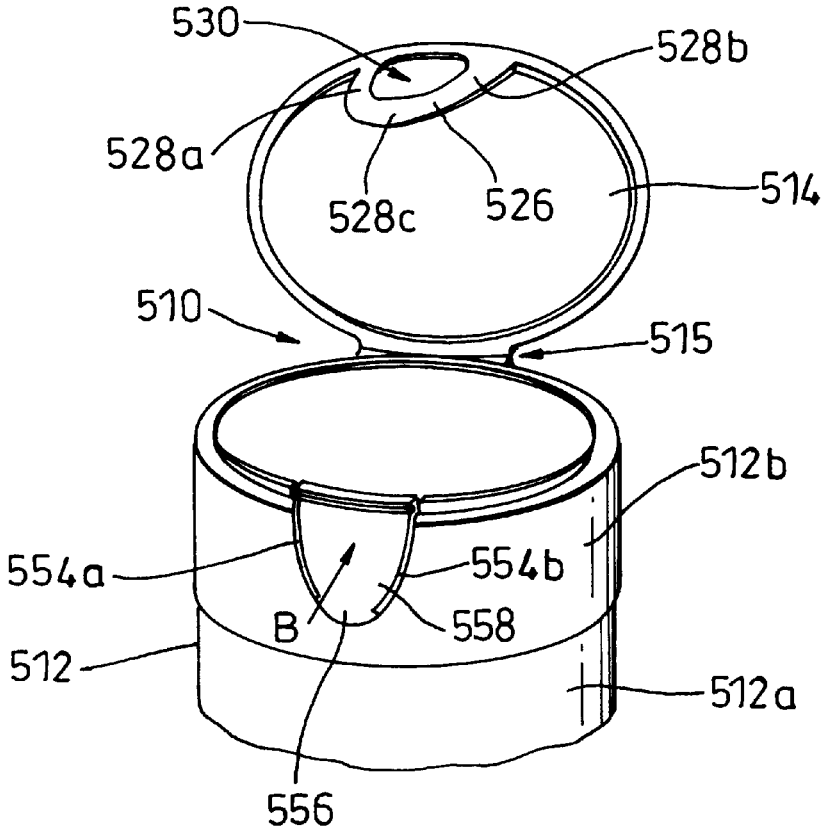
FIG. 18 is a partial perspective view of a paintball container according to a seventh embodiment of the invention.
Figure 19:
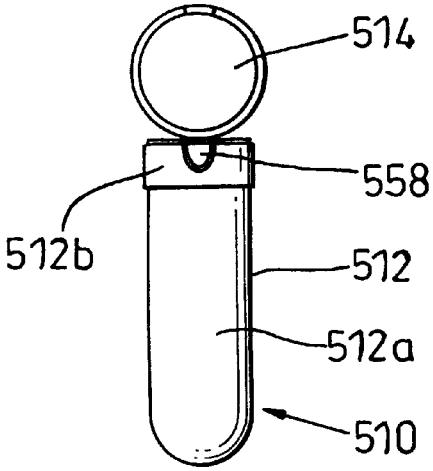
FIG. 19 is a front elevational view of the container of FIG. 18.
Figure 20:
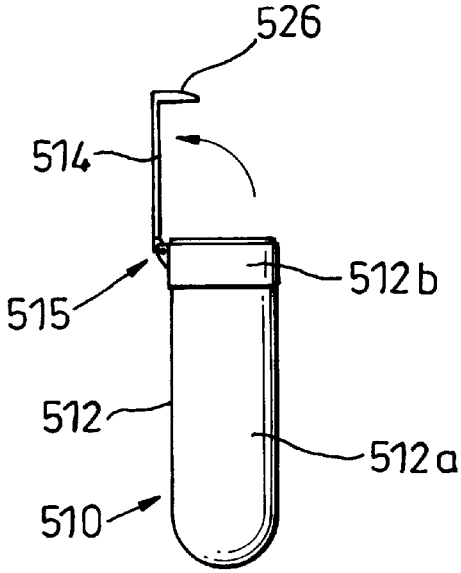
FIG. 20 is a side elevational view of the container of FIG. 18.

Referring to FIGS. 18 to 20 a paintball container 510 according to a seventh embodiment of the present invention is disclosed which is similar to the sixth embodiment, with corresponding features indicated by the same reference numerals increased by 100. The only difference between the seventh embodiment and the sixth is that, in the seventh, the body 512 is made in two parts, being formed from a tubular portion 512*a* and a collar 512*b*. The collar 512*b* has the catch 558 formed in it and the hinge 515 partly formed on it, and the tubular portion 512*a* is therefore a simple tube. The lid 514 of this embodiment is the same as that of the sixth embodiment.

Figure 21:
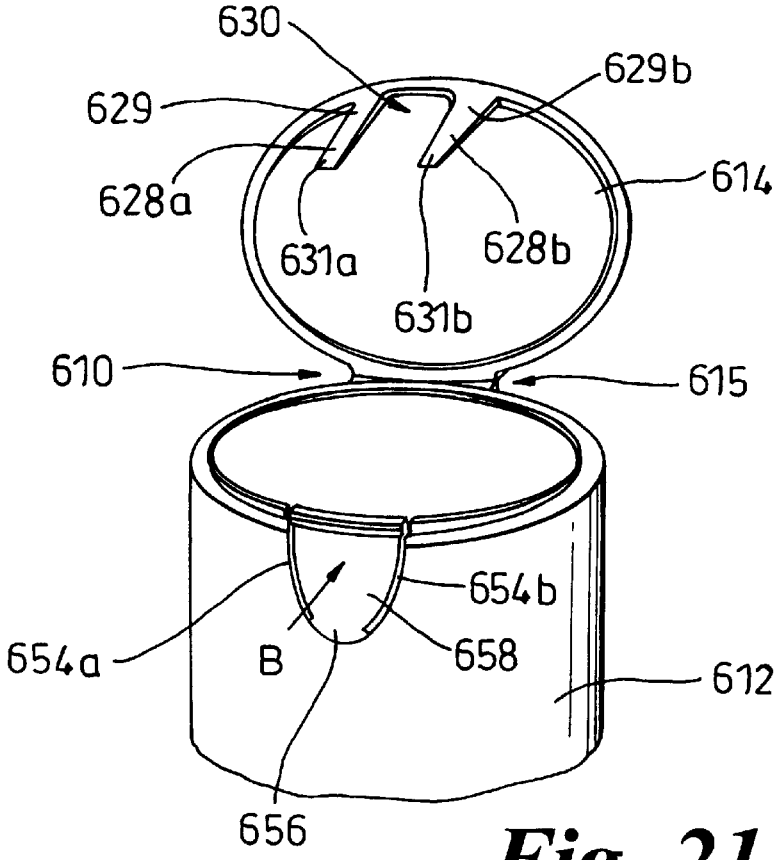
FIG. 21 is a partial perspective view of a paintball container according to an eighth embodiment of the invention.
Figure 23:
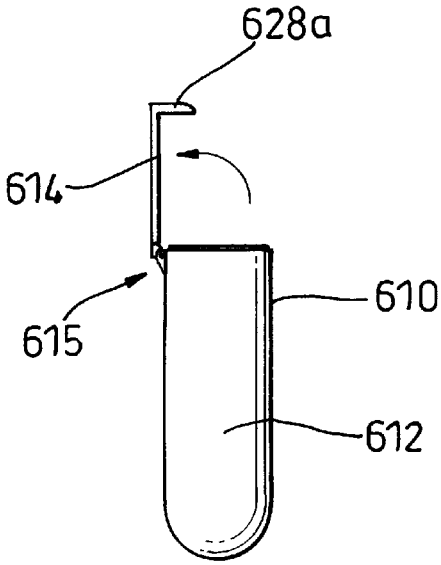
FIG. 23 is a side elevational view of the container of FIG. 21.
Figure 22:
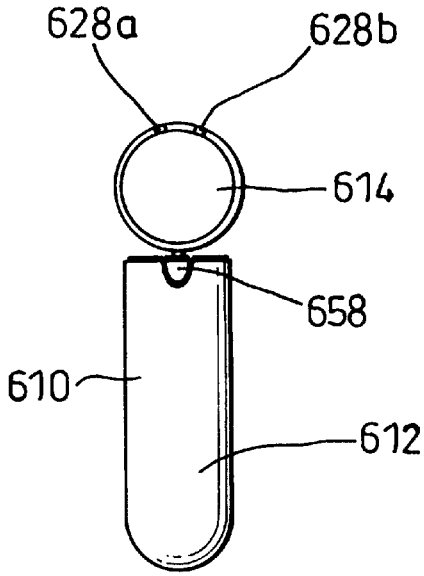
FIG. 22 is a front elevational view of the container of FIG. 21.

Referring to FIGS. 21 to 23 a paintball container 610 according to an eighth embodiment of the present invention is disclosed which is similar to the sixth embodiment, with corresponding features indicated by the same reference numerals increased by 200. The only difference between the eighth embodiment and the sixth is that, in the eighth, the guard 626 is formed as two separate projections 628*a*, 628*b* which are tapered from their upper ends 629*a*, 629*b*, where they are joined to the lid 614, to their lower ends 631*a*, 631*b*. The aperture 630 defined between the projections 628*a*, 628*b* is open at its lower end. When the lid is in the closed position the projections 628*a*, 628*b* lie against the body 612 partly overlying the slots 654*a*, 654*b* at either side of the catch 658.

To open the lid 614, the user places his thumb through the aperture 630 and depresses the catch 658. Because the aperture is open at its lower end, the lid can open under the force of the spring loaded hinge 615 without the user needing to lift it up or remove his thumb.

Figure 24:
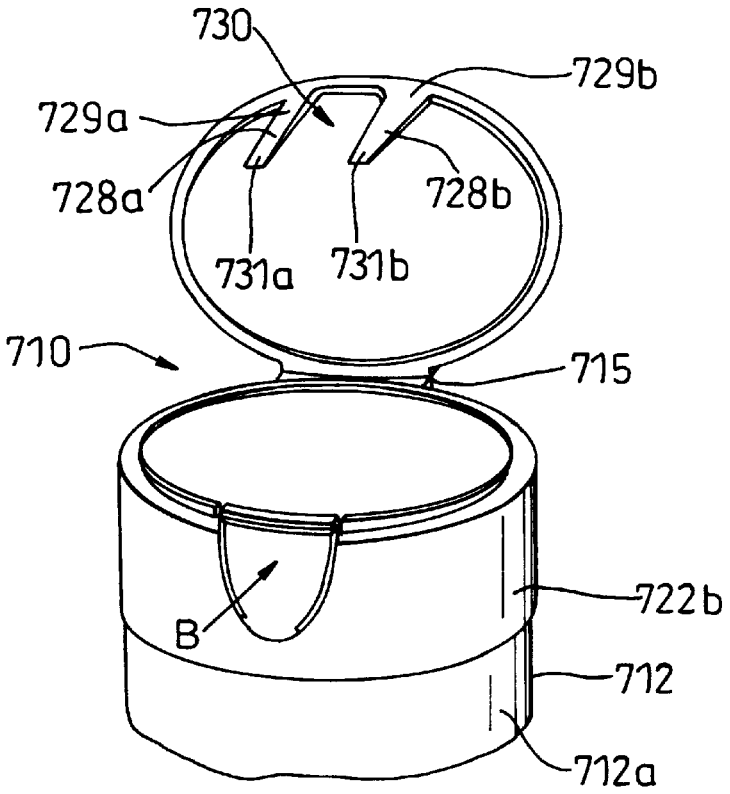
FIG. 24 is a partial perspective view of a paintball container according to a ninth embodiment of the invention.
Figure 25:
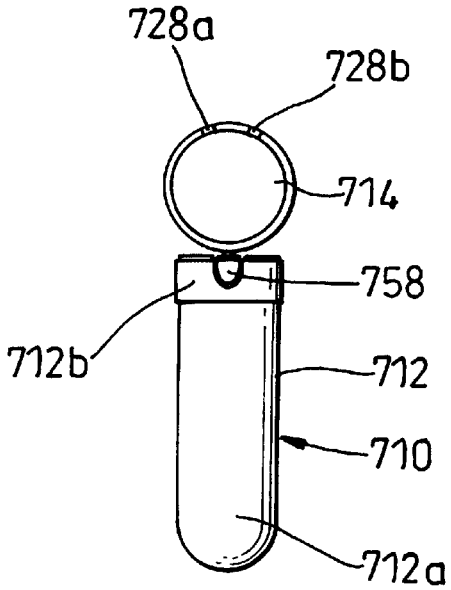
FIG. 25 is a front elevational view of the container of FIG. 24.
Figure 26:
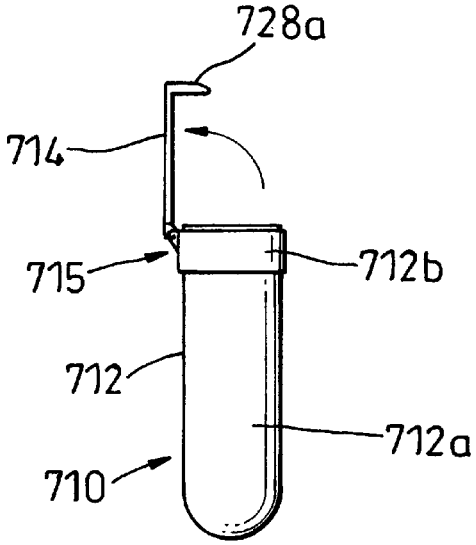
FIG. 26 is a side elevational view of the container of FIG. 24.

Referring to FIGS. 24 to 26 a paintball container 710 according to a ninth embodiment of the present invention is disclosed which is similar to the eighth embodiment, with corresponding features indicated by the same reference numerals increased by 100. The only difference between the ninth embodiment and the eighth is that, in the ninth, the body 712 is made in two parts, being formed from a tubular portion 712*a* and a collar 712*b*. The collar 712*b* has the catch 758 formed in it and the hinge 715 partly formed on it, and the tubular portion 712*a* is therefore a simple tube. The lid 714 of this embodiment is the same as that of the sixth embodiment.

Figure 27:
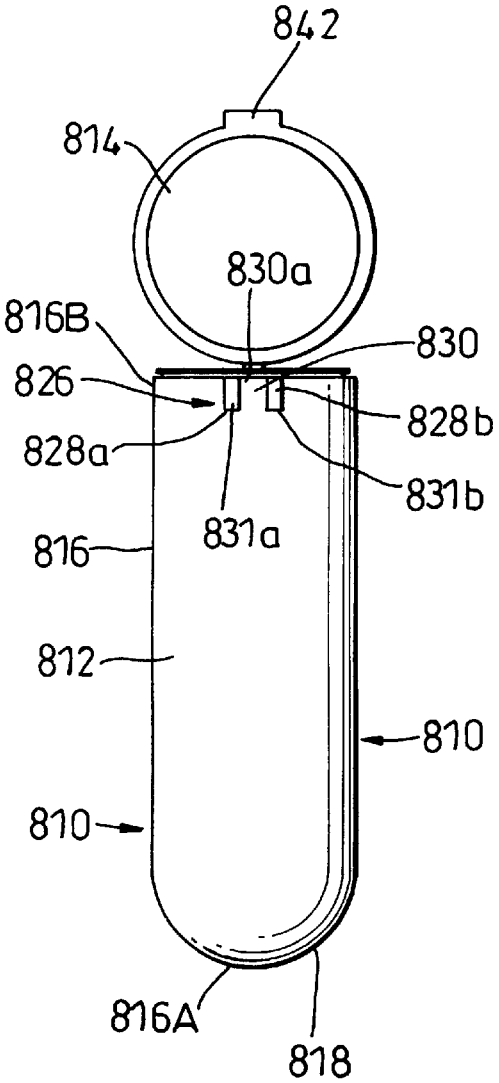
FIG. 27 is a front elevational view of a container according to a tenth embodiment of the invention.
Figure 28:
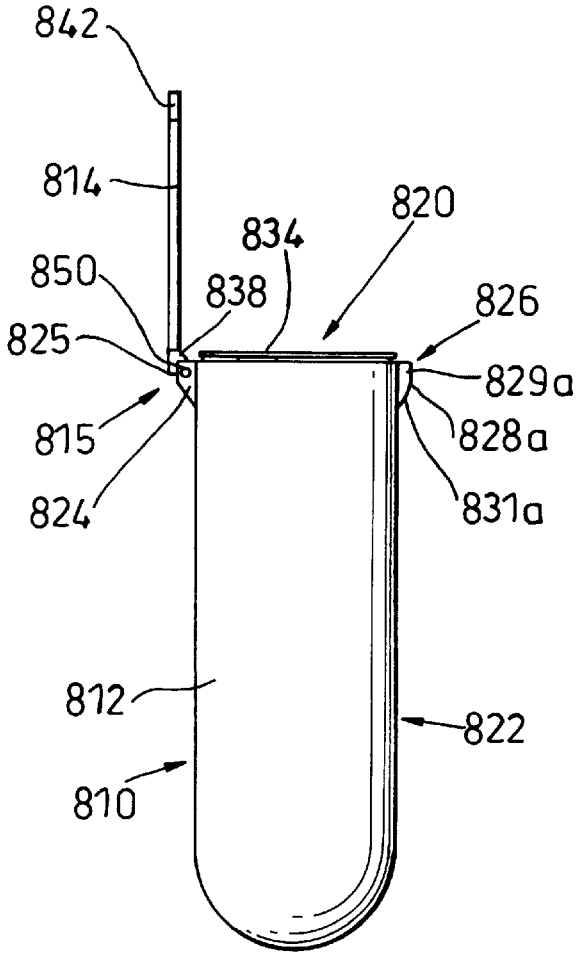
FIG. 28 is a side elevational view of the container of FIG. 27.

Referring to FIGS. 27 and 28 a paintball container 810 according to a tenth embodiment of the present invention is disclosed which is similar to the first embodiment of FIGS. 3 and 4, with corresponding features indicated by the same reference numerals increased by 700. The only difference between the tenth embodiment and the first is that, in the tenth, the guard 826 is formed as two separate projections 828*a*, 828*b* formed on the side of the body 812. Each of the projections 828*a*, 828*b* extends vertically down the side of the body 812. The projections 828*a*, 828*b* are tapered in the radial direction of the container 810 from their upper ends 829*a*, 829*b* where they are widest, to their lower ends 831*a*, 831*b* where they are narrowest. The upper ends 829*a*, 829*b* of the projections 828*a*, 828*b* are aligned with the sides 842*a*, 842*b* of the tab 842 on the lid 814. The recess 830 is defined between the two projections 828*a*, 828*b*, which extend down either side thereof, and the tab 842 on the lid defines the upper end 830*a* of the recess when the lid 814 is in the closed condition.

To open the container 810 the user places a thumb or finger in the recess 830 between the two projections 828*a*, 828*b* and pushes against the tab 842 to lift the lid.

From the foregoing it will be observed that numerous modifications and variations can be effected without departing from the true spirit and scope of the present invention. It is to be understood that no limitations with respect to the specific embodiments is intended or should be inferred. The disclosure is intended to cover, by the appended claims, all such modifications as fall within the scope of the claims.

What is claimed is:

1. A paintball container comprising a body of substantially constant cross section over the length of the container, a lid, and a hinge connecting the lid to the body, the lid being movable into a closed position in which it is arranged to engage with the body to close the container, wherein the container includes a release means positioned substantially opposite the hinge to enable opening of the container, and the body has a guard protruding laterally therefrom, the guard being substantially opposite the hinge so that, with the lid in the closed condition, the guard is adjacent at least part of the release means, thereby being arranged to direct a foreign body travelling longitudinally over the body towards the lid past the release means to prevent unintentional opening of the container, said container having defined therein a recess arranged to accommodate a user's digit wherein the guard at least partially circumscribes the recess and is sloped or curved towards the release means to guide the user's digit into the recess and into contact with the release means.

2. A container according to claim 1 wherein the release means is located in the recess.

3. A container according to claim 1 comprising a catch for holding the lid in the closed condition, wherein the release means is constructed and arranged to release the catch.

4. A container according to claim 1 wherein the guard comprises two side portions one on either side of the recess.

5. A container according to claim 1 wherein the lid is attached to the body by a hinge so as to be movable to an open position, and the container further comprises a spring arranged to urge the lid towards the open position.

6. A container according to claim 1 wherein the guard projects from the body at least as far as the release means.

7. A container according to claim 1 wherein the container defines a circumferential direction, and the guard is at least as wide in the circumferential direction as the release means.

8. A container according to claim 1 wherein the body comprises a tubular portion and a collar and the guard is formed by the collar.

9. A container according to claim 1 wherein the release means is formed on the body.

10. A container according to claim 9 wherein the release means is formed integrally with the body.

11. A container according to claim 1 wherein the release means is formed as part of the body by means of at least one slot through the body, the slot being arranged to allow movement of a part of the body.

12. A container according to claim 11 wherein said part of the body has a lip at a free end thereof, and the lid has a slot therein, the lip being arranged to releasably engage in the slot when the lid is in the closed position.

13. A container according to claim 12 wherein said part of the body is resiliently deformable and is constructed and arranged to disengage the lip from the slot upon being deformed.

14. A container according to claim 1 wherein the release means comprises a part of the lid arranged to be engaged by the user's digit so as to urge the lid away from the body, thereby opening the container.

15. A container according to claim 14 wherein the release means comprises a tab formed on the lid.

16. A container according to claim 14 wherein said part of the lid circumscribes one side of the recess and the guard and said part of the lid together surround the recess.

17. A container according to claim 1 wherein the guard extends, and tapers inwardly, away from the lid when the lid is in the closed condition.

18. A container according to claim 17 wherein the guard is substantially U-shaped.

19. A container according to claim 18 wherein the body has an open end arranged to be closed by the lid, and the guard has two arms which terminate at the open end of the container.

20. A container according to claim 1 wherein the body has a rim and the lid has a lip thereon which is arranged to frictionally engage the rim when the lid is in the closed position so as to retain the lid in the closed position.

21. A container according to claim 20 wherein the lip and rim are arranged to snap fittingly engage so as to selectively retain the lid in the closed position.

22. A paintball container comprising a body of substantially constant diameter over the length of the container, a lid selectively securable and releasable from a closed position to an open position on the body, release means operable to release the lid from the body to allow opening of the container, and a guard, the guard being aligned with the release means and projecting laterally from the container at least as far as the release means so as to guard the release means from unintentional operation, wherein the container has a recess defined therein which is arranged to accommodate a user's digit, and the guard at least partially circumscribes the recess and is sloped or curved toward the release means to guide the user's digit into contact with the release means.

23. A container according to claim 22 further comprising a spring arranged to urge the lid towards the open position.

24. A container according to claim 22 wherein the release means is formed integrally with the body.

25. A container according to claim 22 wherein the release means is formed on the body.

26. A container according to claim 22 wherein the release means is formed on the lid.

27. A container according to claim 22 wherein the guard is formed on the body.

28. A container according to claim 22 wherein the guard is formed on the lid.

29. A container according to claim 22 wherein the body comprises a tubular portion and a collar and the guard is formed by the collar.

30. A container according to claim 22 wherein the container defines a circumferential direction, the release means extends in the circumferential direction, and the guard is aligned with the release means in the circumferential direction.

31. A container according to claim 30 wherein the release means has an extent in the circumferential direction and the guard extends over substantially the whole of the circumferential extent of the release means.

32. A container according to claim 31 wherein the guard projects from the container at least as far as the release means over substantially the whole of the circumferential extent of the release means.

33. A container according to claim 32 wherein the container has an open end arranged to be closed by the lid and a closed end opposite the open end, and the guard is located adjacent the release means between the release member and the closed end.

34. A container according to claim 22 wherein the release means comprises a part of the lid arranged to be engaged by the user's digit so as to urge the lid away from the body, to open the container when selectively engaged by the user's digit.

35. A container according to claim 34 wherein the release means comprises a tab formed on the lid.

36. A container according to claim 34 wherein said part of the lid bounds one side of the recess and the guard and said part of the lid together completely surround the recess.

37. A container according to claim 22 wherein the recess has a length and a breadth commensurate with the tip of the user's digit whereby the tip of the digit can rest comfortably in the recess.

38. A container according to claim 37 wherein the guard comprises two side portions, one on either side of the recess.

39. A container according to claim 22 wherein the release means is formed as part of the body by means of at least one slot through the body, the slot being arranged to allow movement of said part of the body.

40. A container according to claim 39 wherein said part of the body has a lip at a free end thereof, and the lid has a slot therein, the lip being arranged to releasably engage in the slot when the lid is in the closed condition.

41. A container according to claim 40 wherein said part of the body is resiliently deformable and is arranged to disengage the lip from the slot upon being deformed.

42. A container according to claim 22 further comprising a second release means operable to release the lid from the body so as to allow selective opening of the container, and a second guard, the second guard being aligned with the second release means and projecting from the container at least as far as the second release means so as to guard the release means from unintentional operation.

43. A container according to claim 42 wherein the two release means are arranged on opposite sides of the container to each other.

44. A container according to claim 42 further comprising a hinge connecting the lid to the body, wherein the two release means are equally spaced from the hinge.

45. A paintball container comprising a body, a lid selectively securable and releasable from a closed position to an open position on the body, a release member operable to release the lid from the body to allow opening of the container, and a guard, the guard at least partially defining a recess arranged to accommodate a user's digit and is sloped or curved towards the release means, and the release member being located within the recess whereby the guard is arranged to guide the user's digit into contact with the release member, while at the same time preventing inadvertent operation of the release member.

46. A paintball container according to claim 45 wherein the body is of substantially constant cross section over the length of the container.

47. A paintball container comprising a body of substantially constant cross section over the length of the container, a lid, and a hinge connecting the lid to the body, the lid being movable into a closed position in which it is arranged to engage with the body to close the container, wherein the container includes a release means positioned substantially opposite the hinge to enable opening of the container, and the body has a guard protruding laterally therefrom, the guard being substantially opposite the hinge so that, with the lid in the closed condition, the guard is adjacent at least part of the release means, thereby being arranged to direct a foreign body travelling longitudinally over the body towards the lid past the release means to prevent unintentional opening of the container, said container having defined therein a recess arranged to accommodate a user's digit wherein the guard at least partially circumscribes the recess and is substantially U-shaped to guide the user's digit into the recess and into contact with the release means.

48. A paintball container comprising a body of substantially constant cross section over the length of the container, a lid, and a hinge connecting the lid to the body, the lid being movable into a closed position in which it is arranged to engage with the body to close the container, wherein the container includes a release means positioned substantially opposite the hinge to enable opening of the container, and the body has a guard protruding laterally therefrom, the guard being substantially opposite the hinge so that, with the lid in the closed condition, the guard is adjacent at least part of the release means, thereby being arranged to direct a foreign body traveling longitudinally over the body towards the lid past the release means to prevent unintentional opening of the container, said container having defined therein a recess arranged to accommodate a user's digit wherein the guard at least partially circumscribes the recess and is sloped or curved towards the release means to guide the user's digit into the recess and into contact with the release means, wherein the part of the lid arranged to be engaged by the user's digit circumscribes one side of the recess and the guard and the part of the lid arranged to be engaged by the user's digit together surround the recess; and wherein the recess is substantially U-shaped having a top end at least partially circumscribed by the part of the lid arranged to be engaged by the user's digit and a curved part at least partially circumscribed by the guard.

49. A paintball container comprising a body of substantially constant diameter over the length of the container, a lid selectively securable and releasable from a closed position to an open position on the body, release means operable to release the lid from the body to allow opening of the container, and a guard, the guard being aligned with the release means and projecting laterally from the container at least as far as the release means so as to guard the release means from unintentional operation, wherein the container has a recess defined therein which is arranged to accommodate a user's digit, and the guard at least partially circumscribes the recess thereby to guide the user's digit into contact with the release means;

wherein the container defines a circumferential direction, the release means extends in the circumferential direction, and the guard is aligned with the release means in the circumferential direction;

wherein the release means has an extent in the circumferential direction and the guard extends over substantially the whole of the circumferential extent of the release means;

wherein the release means comprises a part of the lid arranged to be engaged by the user's digit so as to urge the lid away from the body, to open the container when selectively engaged by the user's digit;

wherein said part of the lid bounds one side of the recess and the guard and said part of the lid together completely surround the recess; and wherein the recess is substantially U-shaped having a top end at least partially circumscribed by said part of the lid and a curved part at least partially circumscribed by the guard.

50. A paintball container comprising a body of substantially constant diameter over the length of the container, a lid selectively securable and releasable from a closed position to an open position on the body, release means operable to release the lid from the body to allow opening of the container, and a guard, the guard being aligned with the release means and projecting laterally from the container at least as far as the release means so as to guard the release means from unintentional operation, wherein the container has a recess defined therein which is arranged to accommodate a user's digit and is sloped or curved toward the release means, and the guard at least partially circumscribes the recess thereby to guide the user's digit into contact with the release means.

51. A paintball container comprising a body, a lid, and a hinge connecting the lid to the body, the lid being movable into a closed position in which it is arranged to engage with the body to close the container, wherein the container includes a release means positioned substantially opposite the hinge to enable opening of the container, and the body has a guard protruding laterally therefrom, the guard being substantially opposite the hinge so that, with the lid in the closed condition, the guard is adjacent at least part of the release means, thereby being arranged to direct a foreign body travelling longitudinally over the body towards the lid past the release means to prevent unintentional opening of the container, said container having defined therein a recess arranged to accommodate a user's digit wherein the guard at least partially circumscribes the recess and is substantially U-shaped to guide the user's digit into the recess and into contact with the release means.

52. A paintball container comprising a body of substantially constant cross section over the length of the container, a lid, and a hinge connecting the lid to the body, the lid being movable into a closed position in which it is arranged to engage with the body to close the container, wherein the container includes a release means positioned substantially opposite the hinge to enable opening of the container, and the body has a guard protruding laterally therefrom, the guard being substantially opposite the hinge so that, with the lid in the closed condition, the guard is adjacent at least part of the release means, thereby being arranged to direct a foreign body traveling longitudinally over the body towards the lid past the release means to prevent unintentional opening of the container, said container having defined therein a recess arranged to accommodate a user's digit wherein the guard at least partially circumscribes the recess and is sloped or curved towards the release means to guide the user's digit into the recess and into contact with the release means, wherein the part of the lid arranged to be engaged by the user's digit circumscribes one side of the recess and the guard and the part of the lid arranged to be engaged by the user's digit together surround the recess; and wherein the recess is substantially U-shaped having a top end at least partially circumscribed by the part of the lid arranged to be engaged by the user's digit and a curved part at least partially circumscribed by the guard.

53. A paintball container comprising a body, a lid selectively securable and releasable from a closed position to an open position on the body, release means operable to release the lid from the body to allow opening of the container, and a guard, the guard being aligned with the release means and projecting laterally from the container at least as far as the release means so as to guard the release means from unintentional operation, wherein the container has a recess defined therein which is arranged to accommodate a user's digit, and the guard at least partially circumscribes the recess thereby to guide the user's digit into contact with the release means;

wherein the container defines a circumferential direction, the release means extends in the circumferential direction, and the guard is aligned with the release means in the circumferential direction;

wherein the release means has an extent in the circumferential direction and the guard extends over substantially the whole of the circumferential extent of the release means;

wherein the release means comprises a part of the lid arranged to be engaged by the user's digit so as to urge the lid away from the body, to open the container when selectively engaged by the user's digit;

wherein said part of the lid bounds one side of the recess and the guard and said part of the lid together completely surround the recess; and wherein the recess is substantially U-shaped having a top end at least partially circumscribed by said part of the lid and a curved part at least partially circumscribed by the guard.

54. A paintball container comprising a body, a lid selectively securable and releasable from a closed position to an open position on the body, release means operable to release the lid from the body to allow opening of the container, and a guard, the guard being aligned with the release means and projecting laterally from the container at least as far as the release means so as to guard the release means from unintentional operation, wherein the container has a recess defined therein which is arranged to accommodate a user's digit and is sloped or curved toward the release means, and the guard at least partially circumscribes the recess thereby to guide the user's digit into contact with the release means.

55. A paintball container comprising a body, a lid selectively securable and releasable from a closed position to an open position on the body, release means operable to release the lid from the body to allow opening of the container, and a guard, the guard being aligned with the release means and projecting laterally from the container at least as far as the release means so as to guard the release means from unintentional operation, wherein the container has a recess defined therein by the guard, the guard comprising two side portions, one on either side of the recess, the side portions being spaced apart and projecting laterally from each other a sufficient distance to accommodate a single digit of a user so as to allow single digit operation of the release means, the release means defining the upper end of the recess and enclosing the entire upper end of the recess when the lid is in a closed position so as to guard the release means from unintentional operation.

* * * * *